US011469564B2

(12) United States Patent
Yang et al.

(10) Patent No.: US 11,469,564 B2
(45) Date of Patent: Oct. 11, 2022

(54) JOINT CRIMPING APPARATUS

(71) Applicants: Tyco Electronics (Shanghai) Co. Ltd., Shanghai (CN); TE Connectivity Services GmbH, Schaffhausen (CH)

(72) Inventors: An Yang, Shanghai (CN); Lvhai Hu, Shanghai (CN); Sun Kyu Pak, Middletown, PA (US); Roberto Francisco-Yi Lu, Bellevue, WA (US); Yun Liu, Shanghai (CN)

(73) Assignees: Tyco Electronics (Shanghai) Co. Ltd., Shanghai (CN); TE Connectivity Services GmbH, Schaffhausen (CH)

( * ) Notice: Subject to any disclaimer, the term of this patent is extended or adjusted under 35 U.S.C. 154(b) by 0 days.

(21) Appl. No.: 16/952,738

(22) Filed: Nov. 19, 2020

(65) Prior Publication Data

US 2021/0159656 A1 May 27, 2021

(30) Foreign Application Priority Data

Nov. 21, 2019 (CN) ..... 201911153199.0

(51) Int. Cl.
*H01R 43/048* (2006.01)
*H01R 43/058* (2006.01)

(52) U.S. Cl.
CPC ..... *H01R 43/048* (2013.01); *H01R 43/058* (2013.01)

(58) Field of Classification Search
CPC .. H01R 43/042; H01R 43/048; H01R 43/058; Y10T 29/49174; Y10T 29/49183; Y10T 29/49185; Y10T 29/53235
USPC ..... 29/857, 861–863, 748, 751
See application file for complete search history.

(56) References Cited

U.S. PATENT DOCUMENTS 3,075,567 A * 1/1963 Busler ..... H01R 43/048 29/33.52
3,911,717 A * 10/1975 Yuda ..... H01R 43/055 29/753
8,434,219 B2 * 5/2013 Dierks ..... H01R 43/042 29/753

* cited by examiner

*Primary Examiner* — Donghai D Nguyen
(74) *Attorney, Agent, or Firm* — Barley Snyder

(57) ABSTRACT

A joint crimping apparatus adapted to crimp a joint to an end of a cable includes a base, a fixed die detachably mounted on the base, a movable die configured to reciprocate relative to the fixed die, and a separation mechanism. The fixed die has a first groove adapted to receive a portion of a joint in an un-crimped state. The movable die has a second groove adapted to cooperate with the first groove to crimp the joint to the end of the cable. The separation mechanism is configured to remove the cable jammed in the second groove and crimped with the joint from the second groove.

20 Claims, 7 Drawing Sheets

JOINT CRIMPING APPARATUS

CROSS-REFERENCE TO RELATED APPLICATION

This application claims the benefit of the filing date under 35 U.S.C. § 119(a)-(d) of Chinese Patent Application No. 201911153199.0, filed on Nov. 21, 2019.

FIELD OF THE INVENTION

The present disclosure relates to a crimping apparatus and, more particularly, to a joint crimping apparatus adapted to crimp a joint to an end of a cable.

BACKGROUND

In the related art, in order to facilitate a connection of a cable with other cables or electronic devices, a joint crimping apparatus is usually used to pre-mount a joint on an end of the cable by crimping. The joint crimping apparatus includes a fixed die and a movable die movable relative to the fixed die. The fixed die and the movable die are respectively provided with grooves matched with the cable and the joint to be crimped. During a crimping process, the joint is pre-mounted on the end of the cable. Thereafter, the end of the cable crimped with the joint is placed in the groove of the fixed die, and the movable die is driven to move toward the fixed die so as to crimp the joint to the end of the cable.

After the crimping operation is completed, the movable die is driven to be separated from the fixed die to remove the cable crimped with the joint. However, since a force of the movable die for crimping the joint is relatively large, the joint is often jammed in the groove of the movable die and moves with the movable die. In this way, a placement state of the cable may change, and it is not easy to remove the cable.

SUMMARY

A joint crimping apparatus adapted to crimp a joint to an end of a cable includes a base, a fixed die detachably mounted on the base, a movable die configured to reciprocate relative to the fixed die, and a separation mechanism. The fixed die has a first groove adapted to receive a portion of a joint in an un-crimped state. The movable die has a second groove adapted to cooperate with the first groove to crimp the joint to the end of the cable. The separation mechanism is configured to remove the cable jammed in the second groove and crimped with the joint from the second groove.

BRIEF DESCRIPTION OF THE DRAWINGS

The invention will now be described by way of example with reference to the accompanying Figures, of which.

DETAILED DESCRIPTION OF THE EMBODIMENTS

Figure 1:
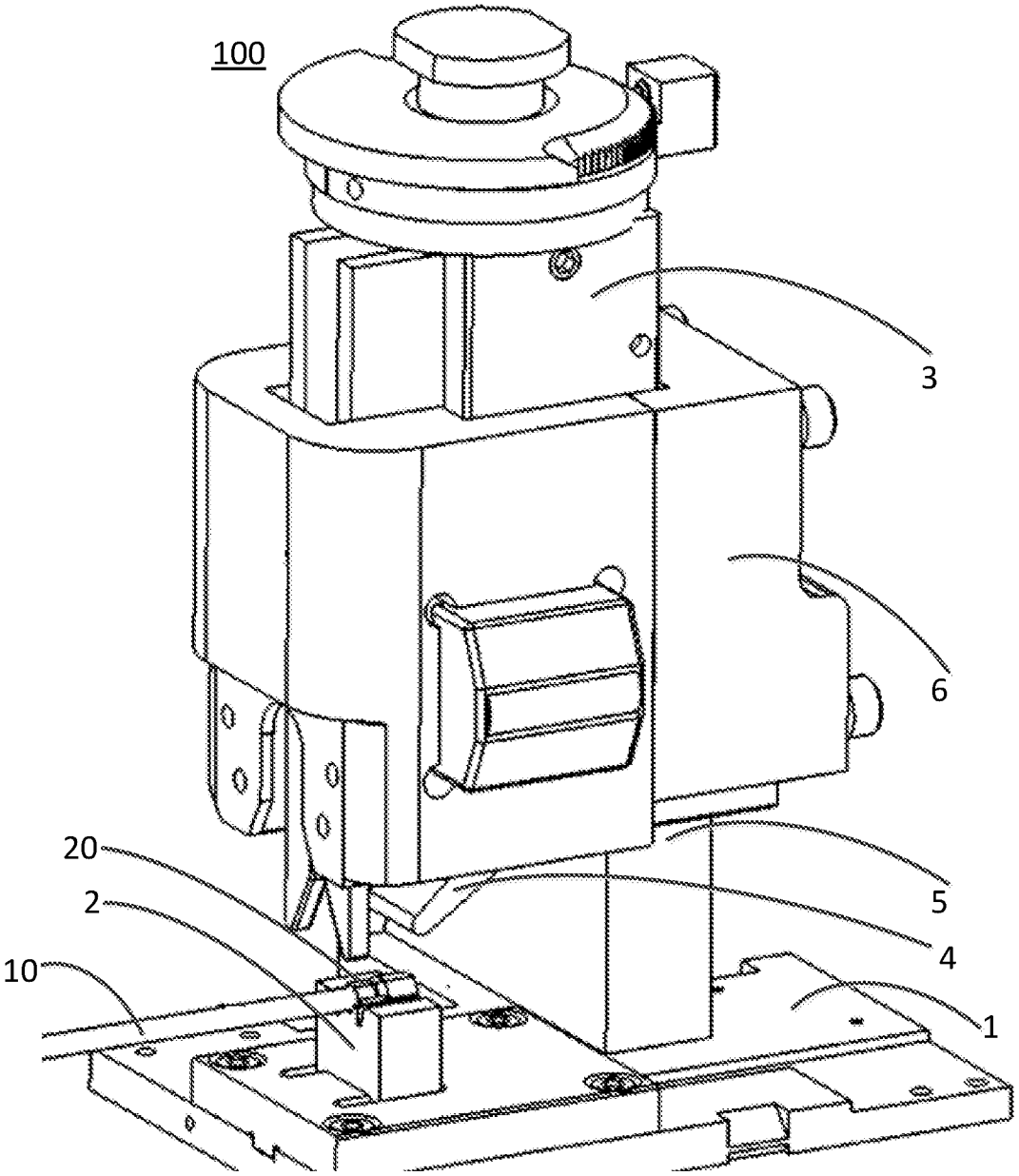
FIG. 1 is a perspective view of a joint crimping apparatus according to an embodiment.

The technical solution of the disclosure will be described hereinafter in further detail with reference to the following embodiments, taken in conjunction with the accompanying drawings. In the description, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

Figure 2:
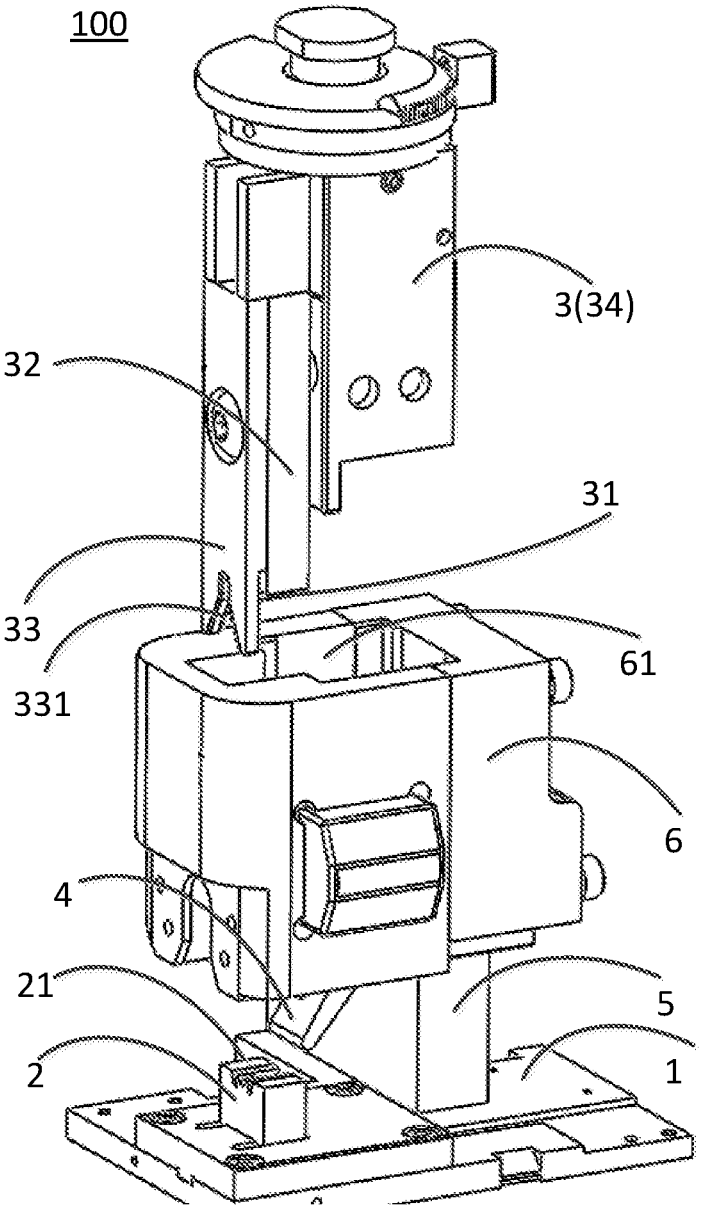
FIG. 2 is an exploded perspective view of the joint crimping apparatus.
Figure 3:
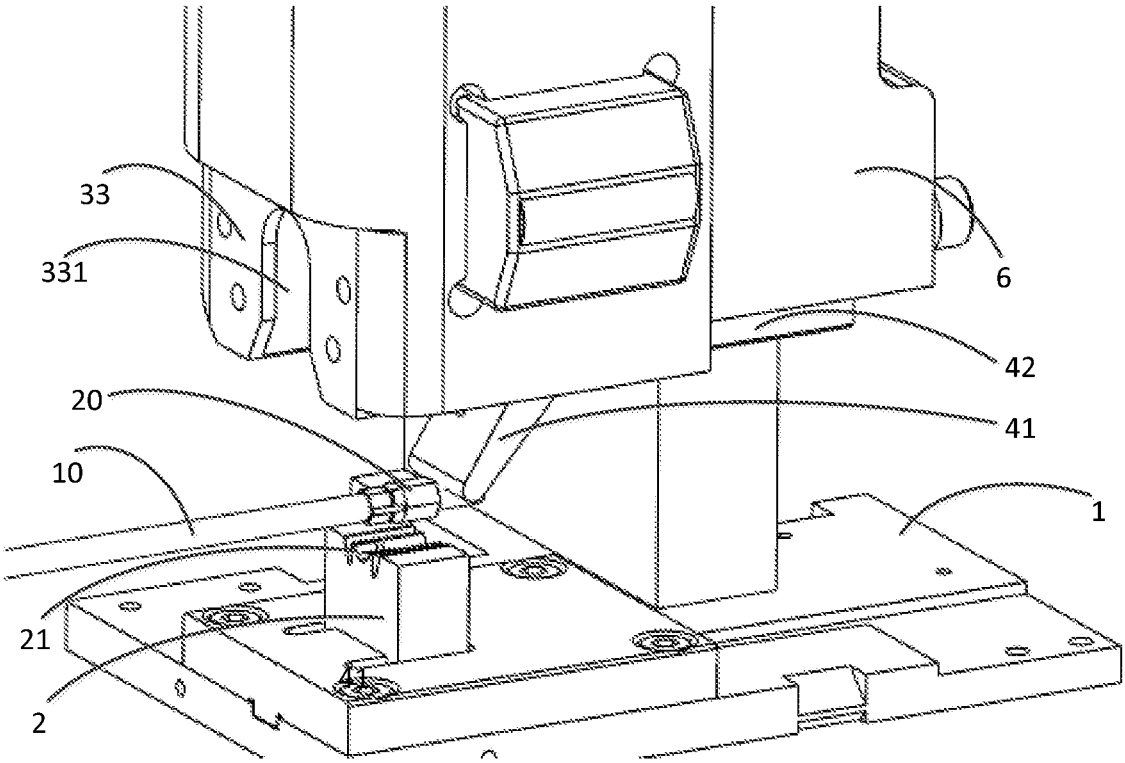
FIG. 3 is a detail perspective view of a lower part of the joint crimping apparatus.

A joint crimping apparatus 100 according to an exemplary embodiment, as shown in FIGS. 1 to 3, is adapted to crimp a joint 20 to an end of a cable 10. The joint crimping apparatus 100 includes a base 1, a fixed die 2 detachably mounted on the base 1 and provided with a first groove 21 adapted to receive at least one portion of an un-crimped joint 20 sleeved on the end of the cable 10, a movable die 3 configured to reciprocate relative to the fixed die 2 and provided with a second groove 31 adapted to cooperate with the first groove 21 to crimp the joint 20 to the end of the cable 10, and a separation mechanism 4 configured to remove the cable 10 jammed in the second groove 31 and crimped with the joint 20 from the second groove 31.

In an embodiment, the joint crimping apparatus 100 includes a drive device adapted to drive the movable die 3 to reciprocate relative to the fixed die 2. Examples of the drive device include, but are not limited to, a hydraulic drive device based on a hydraulic cylinder, a pneumatic drive device based on a pneumatic cylinder, and an electric drive device based on an electric motor or an electromagnetic attraction mechanism. Although the joint crimping apparatus 100 as shown is arranged vertically, that is, the movable die 3 may reciprocate in a vertical direction, the embodiments of the disclosure is not limited thereto. For example, the joint crimping apparatus 100 may be arranged in a horizontal type, that is, the movable die 3 reciprocates relative to the fixed die 2 in the horizontal direction.

In an exemplary embodiment of the disclosure, as shown in FIGS. 1 to 3, the first groove 21 and the second groove 31 are arranged to face toward each other. With this arrangement, a receiving passage of a substantially regular hexagon cross section is defined between the first groove 21 and the second groove 31. In this way, regardless of a shape of an outer contour of the joint 20 to be crimped, for example, the joint 20 to be crimped has a substantially cylindrical shape, at least a portion of the crimped joint 20 has an outer contour of a regular hexagon and may be firmly fixed to the end of the cable 10. In this way, it is convenient to use an external tool such as a wrench to rotate the joint 20 and the cable 10. The joint 20 comprises a conductive joint or an insulation joint. For example, the joint may comprise a conductive terminal suitable for electrically connection with other cables or electronic devices.

In the joint crimping apparatus 100, with the separation mechanism 4 shown in FIGS. 1 to 3, the crimped cable 10 may be driven out of the movable die 3 so that the crimped joint 20 may be loosely placed on the fixed die 2, which is convenient to remove the crimped cable 10 and perform the next crimping operation.

In an exemplary embodiment of the disclosure, as shown in FIGS. 1 to 4, the separation mechanism 4 includes a tongue portion 41 mounted on the base 1 above the fixed die 2. The tongue portion 41 is configured to push the cable 10 jammed in the second groove 31 and crimped with the joint 20 downwardly when the movable die 3 moves upwardly, so that the crimped joint 20 is released from the second groove 31 and falls loosely on the fixed die 2.

The separation mechanism 4 includes a support portion 42 configured to be fixed relative to the base 1; the tongue portion 41 is mounted on the support portion 42.

Figure 4:
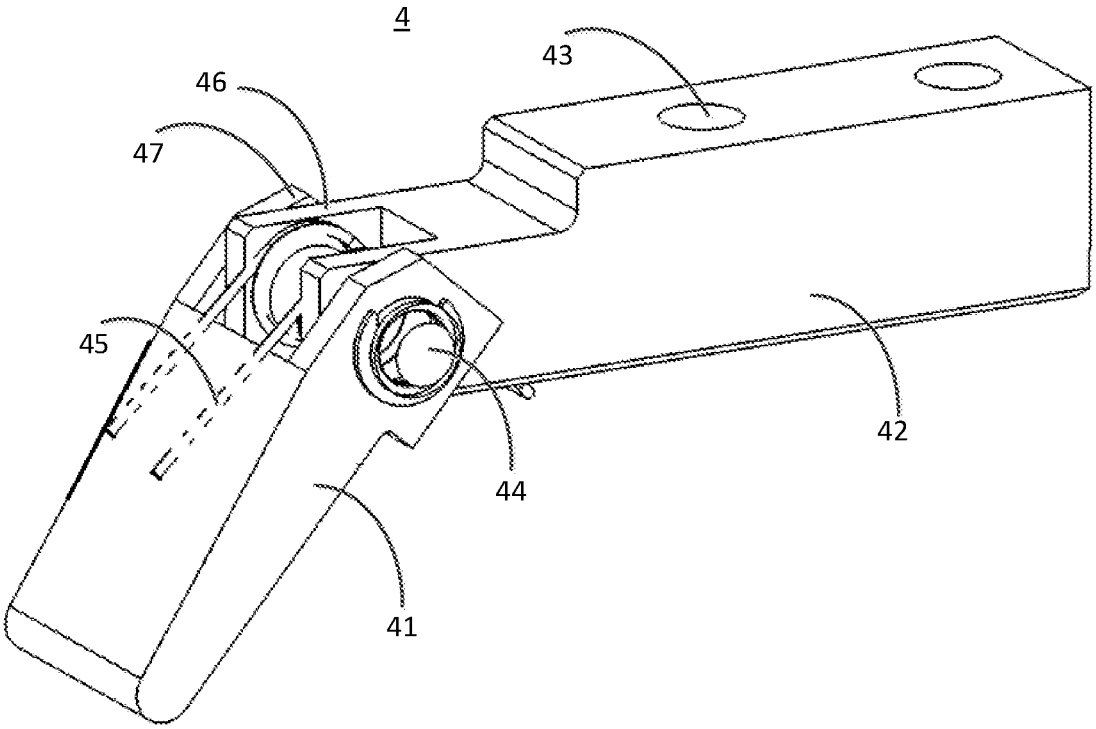
FIG. 4 is a perspective view of a separation mechanism of the joint crimping apparatus.

In an exemplary embodiment of the disclosure, as shown in FIG. 4, the separation mechanism 4 includes a pivot shaft 44 and an elastic mechanism 45. The tongue portion 41 is pivotally mounted on the support portion 42 through the pivot shaft 44. The tongue portion 41 is driven by the movable die 3 to pivot relative to the support portion 42 against an elastic force of the elastic mechanism 45. Further, as shown in FIG. 4, the main body 42 has a pair of first cantilevers 46 at one end thereof. The tongue portion 41 is provided with, at one end thereof, two second cantilevers 47 pivotally connected to the two first cantilevers 46 by the pivot shaft 44. The elastic mechanism 45 has one or two torsion springs having a main body mounted on the pivot shaft 44. Two ends of the torsion spring are mounted on the tongue portion 41 and the support 42 portion, respectively, so that the tongue portion 41 is driven by the movable die 3 to pivot relative to the support portion 42 against the elastic force of the elastic mechanism 45.

In an exemplary embodiment of the disclosure, as shown in FIGS. 1 to 4, the movable die 3 has a pressing portion 32 arranged to face toward the fixed die 2. The second groove 31 is formed in an end of the pressing portion 32. In a case where the movable die 3 does not move downwardly, the elastic mechanism 45 is in an un-pressed state, and the tongue portion 41 is located below the pressing portion 32 due to the elastic mechanism 45. During a movement of the pressing portion 32, the tongue portion 41 is elastically pressed against one side of the pressing portion 32, and pushes the cable 10 jammed in the second groove 31 and crimped with the joint 20 downwardly when the movable die 3 moves upwardly, thereby removing the joint 20 from the second groove 31.

In an exemplary embodiment of the disclosure, as shown in FIGS. 1 to 4, the movable die 3 includes a main body portion 34 and a guide portion 33. The pressing portion 32 is mounted on the main body portion 34. The main body portion 34 is mounted on a driving device. The guide portion 33 is mounted on the pressing portion 32 and provided with a substantially U-shaped guide groove 331 at one end thereof. The guide groove 331 is adapted to guide the end of the cable 10 and the un-crimped joint 20 into the first groove 21. Before the crimping operation, in a case where the end of the cable 10 and the un-crimped joint 20 are not placed within the first groove 21, as the movable die 3 moves downwardly, the guide groove 331 moves the cable 10 and the joint 20 laterally to be moved into the first groove 21.

With the separation mechanism 4 of the above configuration, no additional force is required to drive the separation mechanism 4, and the structure of the joint crimping apparatus 100 is simplified. The joint crimping apparatus 100 may automatically separate the crimped cable 10 from the movable die 3.

Although an embodiment in which the separation mechanism 4 is provided inside (the right side in FIGS. 5-7) the pressing portion 32 is illustrated, the embodiment of the disclosure is not limited thereto. It should be understood that without affecting the reciprocation of the movable die 3, as long as the tongue portion 41 may extend above the first groove 21 and is brought in contact with the joint 20 jammed in the second groove 31 or the cable 10 at either side of the joint 20 when the joint 20 and the cable 10 are driven by the movable die 3 to move upwardly, the separation mechanism 4 may be provided at any side of the pressing portion 32. In this way, the tongue portion 41 may block the cable 10 and the joint 20 from moving further upwardly, thereby removing the joint 20 from the second groove 31.

In an exemplary embodiment of disclosure, as shown in FIGS. 1 to 4, the joint crimping apparatus 100 further comprises a guide mechanism 6 configured to guide the movable die 3 to stably move up and down. The guide mechanism 6 has a guide passage 61 through which the movable die 3 moves. Therefore, the pressing portion 32 of the movable die 3 may be maintained to stably move up and down in the vertical direction, thereby avoiding the first groove 21 and the second groove 31 from not being aligned.

In an exemplary embodiment of the disclosure, the support portion 42 of the separation mechanism 4 is mounted on a lower portion of the guide mechanism 6. For example, the support portion 42 may be mounted on the lower portion of the guide mechanism 6 by inserting a connection member such as a bolt through a through hole 43 formed in the support portion 42, shown in FIG. 4. As appreciated, the main body 34 of the movable die 3 cannot protrude from the lower portion of the guide mechanism 6, while the pressing portion 32 and the guide portion 33 may protrude from the lower portion of the main body 34.

In an exemplary embodiment of the disclosure, the joint crimping apparatus 100 further comprises a support frame 5 on which the guide mechanism 6 is mounted, as shown in FIGS. 1 and 2. In an alternative embodiment of the disclosure, the guide mechanism 6 may be omitted, and the support portion 42 of the separation mechanism 4 is mounted on the support frame 5.

In an exemplary embodiment of the disclosure, the fixed die 2 is detachably mounted on the base 1 to replace the first grooves 21 having different sizes. In this way, the joint crimping apparatus 100 according to the embodiments of the disclosure may crimp joints 20 of different outer sizes onto the cables 10 of different diameters by replacing the fixed dies 2 having the first grooves 21 having different sizes.

Figure 5:
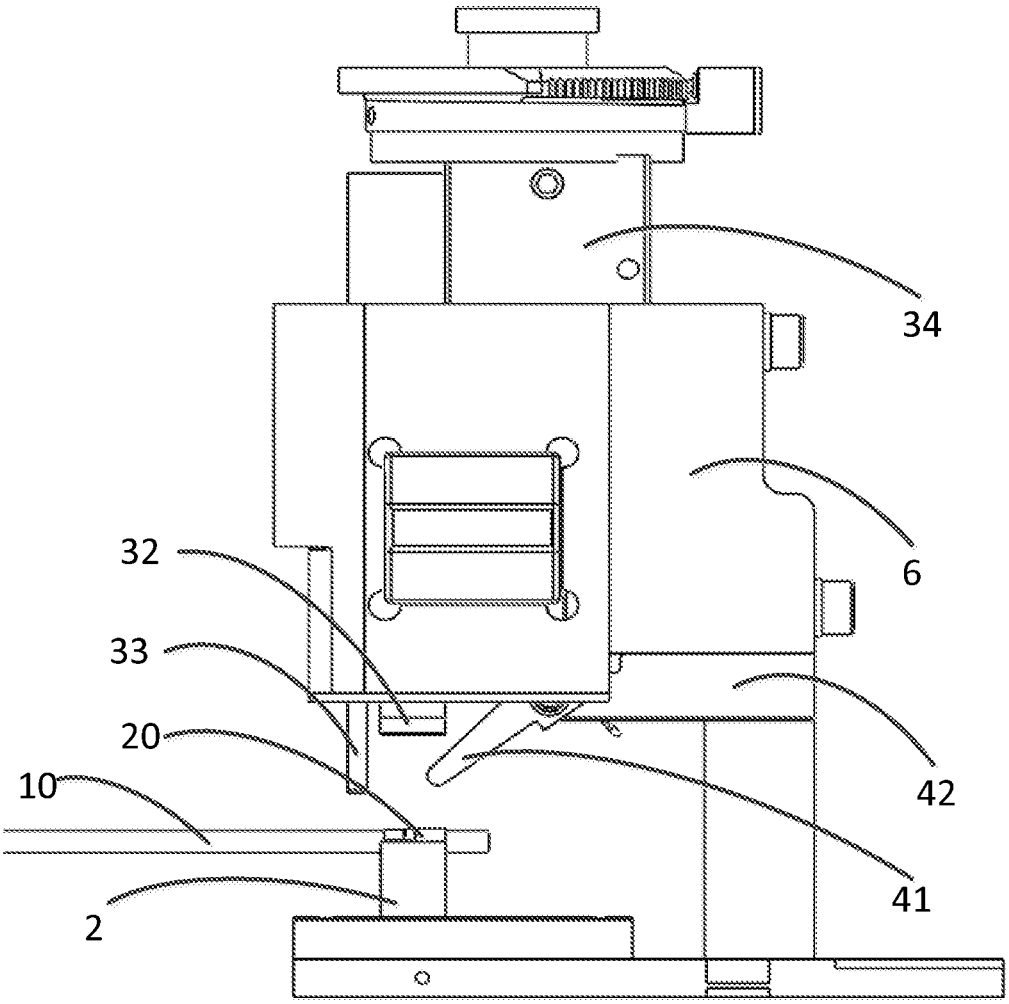
FIG. 5 is a side view of an operation process of using the joint crimping apparatus, in which a pressing portion of a movable die has not yet been brought in contact with a tongue portion of the separation mechanism.
Figure 6:
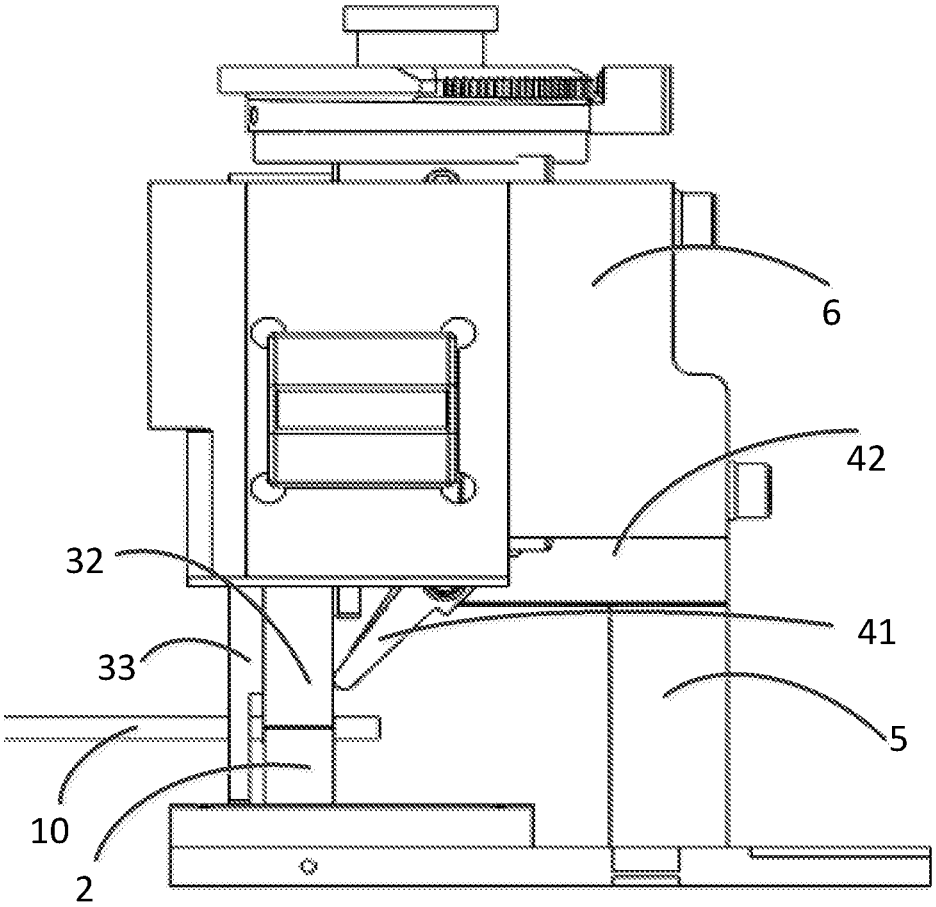
FIG. 6 is a side view of the operation process of using the joint crimping apparatus, in which the pressing portion is pressing a joint in a fixed die.
Figure 7:
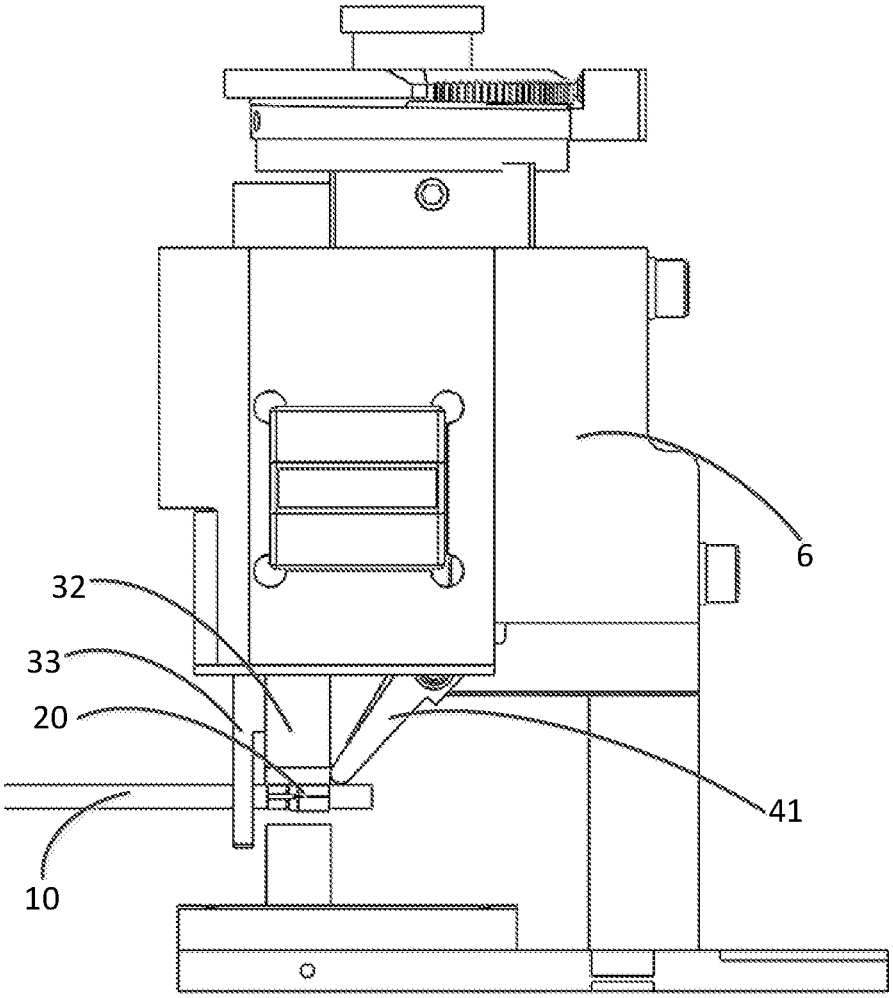
FIG. 7 is a side view of the operation process of using the joint crimping apparatus, in which the pressing portion has been separated from the fixed die but a cable crimped with the joint remains in a second groove of the pressing portion.

FIGS. 5 to 7 show a schematic side view of an operation process of crimping the joint 20 to the end of the cable 10 using the joint crimping apparatus 100 shown in FIG. 1, wherein the pressing portion 32 of the movable die 3 has not yet been brought in contact with the tongue portion 41 of the separation mechanism 4 in FIG. 5, the pressing portion 32 is pressing the joint 20 in the fixed die 2 in FIG. 6, and the pressing portion 32 has been separated from the fixed die 2 but the cable 10 crimped with the joint 20 still remains in the second groove 31 of the pressing portion 32.

The operation process of crimping the joint 20 to the end of the cable 10 by using the joint crimping apparatus 100 according to the embodiment of the disclosure will be described below with reference to FIGS. 5 to 7.

Firstly, the joint 20 to be crimped is initially loosely sleeved on the end of the cable 10, and a portion of the cable 10 protrudes from the joint 20. As shown in FIG. 5, when the movable die 3 is separated from the fixed die 2, the joint 20 to be crimped and the portion of the cable 10 are placed in the first groove 21 of the fixed die 2 from outside (the left side in FIGS. 5 to 7) the pressing portion 32. At this time, the tongue portion 41 is in an initial state and is partially located between the first groove 21 and the pressing portion 32, and does not impede an operation of placing the un-crimped joint 20 and the portion of the cable 10 into the first groove 21 of the fixed die 2.

Thereafter, the movable die 3 is driven to move downwardly by a driving device, and the portion of the cable 10 and the un-crimped joint 20 are guided into the first groove 21 of the fixed die 2 by the guide groove 331 in the guide portion 33. During this, the tongue portion 41 is pressed by a lower end of the pressing portion 32 so that the tongue portion 41 rotates counterclockwise around the pivot shaft 44, and an end of the tongue portion 41 is abutted against an inner side (the right side in FIG. 6) of the pressing portion 32 by the elastic mechanism 45.

As shown in FIG. 6, the pressing portion 32 continues to move downwardly so that the second groove 31 at the end of the pressing portion 32 is tightly engaged with the first groove 21 of the fixed die 2 to press the joint 20 into a substantially regular hexagonal space formed by the first groove 21 and the second groove 31. In this way, the joint 20 is firmly crimped on the end of the cable 10. At this time, the end of the tongue portion 41 is still abutted against the inner side of the pressing portion 32.

As shown in FIG. 7, after the crimping operation is completed, the movable die 3 and its pressing portion 32 move upwardly. Since pressed by the second groove 31, the crimped joint 20 may still remain in the second groove 31 and move upwardly with the pressing portion 32. When the pressing portion 32 moves upwardly so that the cable 10 protruding from the joint 20 is brought in contact with the tongue portion 41, the tongue portion 41 will block the cable 10 from moving further upwardly, thereby separating the cable 10 and the crimped joint 20 from the second groove 31 and allow them to fall loosely on the fixed die 2. Thereafter, it is possible to remove the cable 10 and perform an operation for crimping the next joint.

Although the disclosure has been described hereinbefore in detail with reference to the attached drawings, it should be appreciated that the disclosed embodiments in the attached drawings are intended to illustrate the embodiments of the disclosure by way of example, and should not be construed as a limitation to the disclosure. Although a few embodiments of the general inventive concept of the disclosure have been shown and described, it would be appreciated by those skilled in the art that changes or modification may be made to these embodiments without departing from the principles and spirit of the general inventive concept, the scope of which is defined in claims and their equivalents.

What is claimed is:

1. A joint crimping apparatus adapted to crimp a joint to an end of a cable, comprising:

a base;

a fixed die detachably mounted on the base and having a first groove adapted to receive a portion of a joint in an un-crimped state;

a movable die configured to reciprocate relative to the fixed die and having a second groove adapted to cooperate with the first groove to crimp the joint to the end of the cable; and a separation mechanism movably mounted relative to the base and configured to remove the cable jammed in the second groove and crimped with the joint from the second groove, the separation mechanism including an elastic mechanism biasing the separation mechanism in a direction of the movable die and being driven to move relative to the base and against an elastic force of the elastic mechanism by the movable die.

2. The joint crimping apparatus of claim 1, wherein the separation mechanism has a tongue portion mounted on the base above the fixed die.

3. The joint crimping apparatus of claim 2, wherein the tongue portion is configured to push the cable jammed in the second groove and crimped with the joint downwardly when the movable die moves upwardly.

4. The joint crimping apparatus of claim 3, wherein the separation mechanism includes a support portion fixed relative to the base, the tongue portion is mounted on the support portion.

5. The joint crimping apparatus of claim 4, wherein the separation mechanism includes a pivot shaft through which the tongue portion is pivotally mounted on the support portion.

6. The joint crimping apparatus of claim 4, wherein the tongue portion is driven by the movable die to pivot relative to the support portion against an elastic force of the elastic mechanism.

7. The joint crimping apparatus of claim 6, wherein the movable die has a pressing portion arranged to face toward the fixed die, the second groove is formed within the pressing portion.

8. The joint crimping apparatus of claim 7, wherein, during movements of the pressing portion, the tongue portion is elastically pressed against a side of the pressing portion and pushes the cable jammed in the second groove and crimped with the joint downwardly when the movable die moves upwardly.

9. The joint crimping apparatus of claim 8, wherein the movable die includes a main body portion on which the pressing portion is mounted, the main body portion is mounted on a driving mechanism.

10. The joint crimping apparatus of claim 9, wherein the movable die includes a guide portion mounted on the pressing portion and having a substantially U-shaped guide groove at an end, the guide groove guides the end of the cable and the joint into the first groove.

11. The joint crimping apparatus of claim 4, further comprising a guide mechanism configured to guide the movable die to move up and down.

12. The joint crimping apparatus of claim 11, wherein the guide mechanism has a guide passage through which the movable die moves.

13. The joint crimping apparatus of claim 11, wherein the support portion of the separation mechanism is mounted on a lower portion of the guide mechanism.

14. The joint crimping apparatus of claim 11, further comprising a support frame on which the support portion of the separation mechanism is mounted.

15. The joint crimping apparatus of claim 14, wherein the guide mechanism is mounted on the support frame.

16. The joint crimping apparatus of claim 1, wherein the fixed die is detachably mounted on the base to replace the first groove having one of a plurality of different sizes.

17. The joint crimping apparatus of claim 1, wherein the first groove and the second groove are arranged to face toward each other to define a receiving passage having a substantially regular hexagonal cross section.

18. The joint crimping apparatus of claim 1, wherein the separation mechanism pushes the cable jammed in the second groove and crimped with the joint downwardly when the movable die moves upwardly.

19. A joint crimping apparatus adapted to crimp a joint to an end of a cable, comprising:

a base;

a fixed die mounted on the base and having a first groove adapted to receive a portion of a joint in an un-crimped state;

a movable die configured to reciprocate relative to the fixed die and having a second groove adapted to cooperate with the first groove to crimp the joint to the end of the cable; and a separation mechanism for removing a cable jammed in the second groove and crimped with the joint from the second groove, the separation mechanism including a movable end driven to move relative to the base and against a return force by the movable die, the separation mechanism pushing the cable jammed in the second groove and crimped with the joint downwardly when the movable die moves upwardly.

20. A joint crimping apparatus adapted to crimp a joint to an end of a cable, comprising:

a base;

a fixed die detachably mounted on the base and having a first groove adapted to receive a portion of a joint in an un-crimped state;

a movable die configured to reciprocate relative to the fixed die and having a second groove adapted to cooperate with the first groove to crimp the joint to the end of the cable; and a separation mechanism including:

a tongue portion mounted on the base above the fixed die, the tongue portion configured to remove the cable jammed in the second groove and crimped with the joint from the second groove by pushing the cable downwardly when the movable die moves upwardly;

a support portion fixed relative to the base, the tongue portion is mounted on the support portion; and a pivot shaft through which the tongue portion is pivotally mounted on the support portion.

* * * * *